US006164934A

United States Patent [19]

Niihara et al.

[11] Patent Number: 6,164,934

[45] Date of Patent: Dec. 26, 2000

[54] SEALED TYPE COMPRESSOR

[75] Inventors: Osami Niihara; Hiroshi Takano; Mamoru Ono; Shigeru Muramatsu, all of Shiga, Japan

[73] Assignee: Matsushita Electric Industrial Co., Ltd., Osaka, Japan

[21] Appl. No.: 09/213,378

[22] Filed: Dec. 17, 1998

[51] Int. Cl.[7] ..... F04B 17/00; F04B 35/04

[52] U.S. Cl. ..... 417/423.14; 417/422; 439/282

[58] Field of Search ..... 62/468; 137/386; 174/152; 417/366, 312, 368, 422, 356, 423.14; 418/96, 63; 439/282

[56] References Cited

U.S. PATENT DOCUMENTS

| | | | |
|---|---|---|---|
| Re. 30,994 | 7/1982 | Shaw | 417/366 |
| 3,795,256 | 3/1974 | Gordon | 137/386 |
| 4,296,275 | 10/1981 | Bowsky | 174/152 GM |
| 4,411,600 | 10/1983 | Itagaki et al. | 417/312 |
| 4,518,325 | 5/1985 | Kingston | 417/368 |
| 4,964,788 | 10/1990 | Itamari-Kinter et al. | 417/422 |
| 4,984,973 | 1/1991 | Itamari-Kinter et al. | 417/422 |
| 5,139,394 | 8/1992 | Aikawa et al. | 417/356 |
| 5,222,885 | 6/1993 | Cooksey | 418/96 |
| 5,584,716 | 12/1996 | Bergman | 439/282 |
| 5,842,846 | 12/1998 | Fukuoka et al. | 418/63 |
| 6,006,542 | 12/1999 | Tojo et al. | 62/468 |

FOREIGN PATENT DOCUMENTS

| | | |
|---|---|---|
| 57-129285 | 8/1982 | Japan . |
| 0 183 332 | 6/1986 | Japan . |

*Primary Examiner*—Teresa Walberg
*Assistant Examiner*—Leonid Fastovsky
*Attorney, Agent, or Firm*—Wenderoth, Lind & Ponack, L.L.P.

[57] ABSTRACT

An attempt has been made to prevent damage of a hermetic terminal and to improve pressure-resistance strength of the welded joint of connecting pipes in order to provide a sealed housing 4 having a pressure-resistance strength high enough to allow use of a high-pressure alternative refrigerant. For this purpose, ring-shaped metal members 15 and 23 are welded to the outer peripheries of the welded joints of a hermetic terminal 8 to be hermetically welded to an upper end plate 1 of a sealed housing 4 and a discharge pipe 10. As a result, in the event the internal pressure of the sealed housing 4 increases and the upper end plate 1 deforms in the shape of a sphere, the ring-shaped metal member 15 on the outer periphery of the welded joint of the hermetic terminal 8 suppresses the deformation of the hermetic terminal 8 thus preventing damage of a glass seal 12 of the hermetic terminal 8, and the ring-shaped metal member 23 on the outer periphery of the welded joint of the discharge pipe 10 decreases the tensile stress produced in the welded joint of the discharge pipe 10 thus improving the pressure-resistance strength of the connecting section of the discharge pipe 10 thereby providing a sealed type compressor having a sealed housing 4 with a sufficiently high pressure-resistance strength.

69 Claims, 10 Drawing Sheets

SEALED TYPE COMPRESSOR

FIELD OF THE INVENTION

The present invention relates to a sealed type compressor to be used as a refrigerant compressor for refrigerating and air conditioning or as an air compressor.

BACKGROUND OF THE INVENTION

In a conventional refrigerant compressor of this type, a compression mechanism 105 and a motor 106 to drive the compression mechanism 105 are fixed inside a sealed housing 104 which comprises an upper end plate 101, a body section 102, and a lower end plate 103 as shown in FIG. 20. The source of power to the motor 106 is supplied from an external power supply (not shown) through a hermetic terminal 110 having an electrically conducting pin 109 insulated with a glass seal 108 on a cup-shaped metal member 107 which is hermetically sealed on the sealed housing 104.

A refrigerant is sucked through a suction pipe 111 leading to a refrigeration circuit (not shown) into the compression mechanism 105, compressed, and discharged under a high pressure into the sealed housing 104, and returned to the refrigeration circuit (not shown) through a discharge pipe 112. Therefore, the inside of the sealed housing 104 of this type of compressor is filled with a high-pressure refrigerant.

Although HCFC22 has heretofore been employed as a refrigerant for this type of compressor, a decision has been reached to completely abolish it in the future because of a possibility of depleting the ozone layer by its emission into the air. Among several alternative HFC-based refrigerants to replace HCFC22, R407C, which is a mixture of HFC125, HFC32, and HFC134a, and R410A, which is a mixture of HFC125 and HFC32, are considered to be promising candidates. While the discharge pressure of R407C is approximately equal to that of R22, the discharge pressure of R410A is approximately 1.7 times that of R22.

When using an alternative refrigerant having such a high discharge pressure in a high-pressure type sealed compressor in which the discharge pressure is applied to the sealed housing itself, the pressure-resistance strength of the sealed housing needs to be increased. However, in the above-mentioned prior art structure, as the internal pressure of the sealed housing 104 increases, the upper and lower end plates 101 and 103 swell outward gradually assuming a sphere-like shape. As the hermetic terminal 110 is fixed by welding to a flat section of the upper end plate 101, the deformation causes a stress on the cup-shaped metal member 107 of the hermetic terminal 110, thus deforming it and breaking the glass seal 108, thereby causing leakage of the high-temperature high-pressure refrigerant to the outside. In the prior art construction, as this is the section of which the pressure-resistance strength is the weakest, it is necessary to increase the pressure-resistance strength of this section in order to increase the pressure-resistance strength of the entire sealed housing.

Also, the joints between the sealed housing 104 and the connecting pipes for the refrigerant, namely, the suction pipe 111 and the discharge pipe 112, are parts with the weakest pressure-resistance strength after the hermetic terminal 110 because a tensile stress is exerted thereon due to the high pressure inside the sealed housing 104.

SUMMARY OF THE INVENTION

The present invention has been contrived in order to address the above-described problems of the prior art, and is aimed in particular to prevent breakage of the glass seal of the hermetic terminal, and additionally to improve the pressure-resistance strength of the joints between the sealed housing and connecting pipes for a refrigerant, and to provide a sealed housing with a pressure-resistance strength high enough to withstand high-pressure alternative refrigerants.

For this purpose, in the present invention, a member, such as a ring-shaped metal member, to enhance rigidity of the sealed housing of a sealed type compressor is welded to the welded joints of the hermetic terminal and the connecting pipes for the refrigerant which are to be hermetically welded to the sealed housing in such a way that the member encircles the welded joints. As a result, an inside of the sealed housing becomes high in pressure, and, in the case of the hermetic terminal, even when the sealed housing to which the hermetic terminal and connecting pipes for refrigerant are welded is deformed, the rigidifying member such as the ring-shaped metal member joined to the outer periphery of the welded joint of the hermetic terminal suppresses the deformation of the hermetic terminal and prevents breakage of the glass seal of the hermetic terminal. In the case of the connecting pipes, the ring-shaped metal member joined to the outer periphery of their welded joints reduces the tensile stress produced in the welded joints, thus improving the joining strength of the connecting pipes and improving the pressure-resistance strength of the sealed housing.

In other words, in this invention, a motor and a compression mechanism to be driven by the motor are disposed inside a sealed housing, a hermetic terminal hermetically welded to the sealed housing (including end plates and a flat section) to supply electric power to the motor from outside the sealed housing comprises a cup-shaped metal member, an electrically conducting pin, and a glass seal to insulate the cup-shaped metal member and the electrically conducting pin, and a member to increase rigidity (deformation rigidity) against deformation of the sealed housing is welded to the sealed housing encircling the welded joint between the sealed housing and the hermetic terminal.

Also, in this invention, the member to increase deformation rigidity of the sealed housing is preferably a ring-shaped metal member having a thickness greater than ⅓ of the thickness of the sealed housing, and the weld where the ring-shaped metal member is welded to the sealed housing is preferably an arc in shape. By so doing, the deformation rigidity of that section of the sealed housing where the ring-shaped metal member is welded effectively suppresses deformation of the hermetic terminal.

Also, in this invention, the ring-shaped metal member is welded to the inside of the sealed housing. By welding to the inside, obstruction to a protecting frame member of the hermetic terminal to be formed on the outside and to wiring around leads of the power supply can be avoided.

Also, in this invention, by welding the ring-shaped metal member to the outside of the sealed housing preferably integrally with a protecting frame member of the hermetic terminal, welding of the hermetic terminal to the sealed housing is not obstructed, and integral welding with the protecting frame member is possible, thus making assembly work easy.

Also, in this invention, either by providing a linear protrusion on the welded joint with the sealed housing when welding the ring-shaped metal member to the sealed housing, or by resistance welding as is when the width of the ring is small, the entire ring surface is fixed by welding to the end plates and the like of the sealed housing, such that the deformation rigidity of the end plates and the like of the sealed housing effectively suppresses deformation of the hermetic terminal. When carrying out resistance welding, the width of the ring-shaped metal member will need to be narrowed in order to increase the current density.

Also, in this invention, as a burring-processed hole (i.e. a hole formed with a burr-like projection at its periphery) is provided on the sealed housing and the hermetic terminal is hermetically welded to the hole, deformation of the peripheral edge of the hermetic terminal is suppressed because of burring, thus making it possible to prevent breakage of the glass seal and improve the pressure-resistance strength. When burring is provided on the inside of the sealed housing, hermetic welding of the hermetic terminal is made easy. When burring is provided on the outside of the sealed housing, the deformation force exerted to the glass seal becomes smaller than when burring is provided on the inside.

Also, in this invention, the hermetic terminal is hermetically welded onto a steel plate followed by hermetically welding the steel plate on the end plate etc. of the afore-mentioned sealed housing with some overlap between the steel plate and the end plate. As the rigidity of the overlapping section is large, even when the end plates etc. of the sealed housing onto which the hermetic terminal is welded are deformed, deformation of the hermetic terminal is suppressed, breakage of the glass seal of the hermetic terminal is prevented, and the pressure-resistance strength is improved. When the thickness of the steel plate onto which the hermetic terminal is hermetically welded is greater than the thickness of the sealed housing (end plates etc.), and when the length of the overlap of the steel plate and the sealed housing is greater than the thickness of the sealed housing, the effect of suppressing deformation of the hermetic terminal and preventing breakage of the glass seal becomes more prominent.

Also, this invention is especially effective in a sealed type compressor in which the afore-mentioned sealed housing comprises a body section and an end plate to close an opening of the body section, and a hermetic terminal is hermetically welded to the end plate.

Also, in this invention, an attempt is made to improve pressure-resistance strength of the connecting sections of the connecting pipes (discharge pipe and suction pipe) connecting inside and outside of the sealed housing and through which a refrigerant flows in and out. By welding the ring-shaped metal member to the outer periphery of the welded joint of the connecting pipes, the tensile stress produced in the welded joint by the deformation due to internal pressure of the sealed housing is reduced and the pressure-resistance strength of the connecting sections of the connecting pipes is improved. Also, it is preferable to weld the connecting pipes to a burring-processed hole of the sealed housing for further improvement of the pressure-resistance strength. Furthermore, as the connecting pipes are generally welded by copper brazing, assembly becomes easy if the nearby ring-shaped metal member is brazed at the same time.

Also, in this invention, holes with a diameter equal to or smaller than the inner diameter of the connecting pipes connecting inside and outside of the afore-mentioned sealed housing and through which a refrigerant flows out and in are made and end faces of the connecting pipes are fixed by welding to the outside surface of the sealed housing corresponding to the holes. As a result, when a high pressure is applied to the inside of the sealed housing, a large tensile stress is not applied to the welded joint as its position is different from the prior art. Consequently, pressure-resistance strength of the sealed housing can be improved. Also, by expanding the end faces of the connecting pipes on the side to be fixed by welding to the sealed housing and by increasing the diameter of the holes of the sealed housing, it is also possible to reduce resistance against flow of the refrigerant.

Also, in this invention, by fixing the connecting pipes to the sealed housing by diffusion welding, the temperature rise during welding is made smaller than that of brazing and other methods of welding, and thus the strength of the pipes can be maintained.

Also, in this invention, recessed sections having a diameter equal to or slightly larger than the outside diameter of the connecting pipes are formed on the periphery of the holes of the sealed housing, and end sections of the connecting pipes are inserted into the recessed sections and fixed by welding. Generally, by fixing both of the end faces and the peripheries of the end sections of the connecting pipes to the sealed housing by brazing, in the event a high pressure is applied to the inside of the sealed housing, breakage is suppressed because of the existence of welded joints at two locations facing different directions thus contributing to improvement of the pressure-resistance strength of the sealed housing. Furthermore, sufficient strength is secured in the event a large force (e.g., tensile force) is applied to the afore-mentioned connecting pipes.

Also, in this invention, when the sealed housing comprises a body section and end plates to close openings of the body section as set forth above, and the afore-mentioned hermetic terminal and one of the afore-mentioned connecting pipes are welded to the end plates, the above-described structure of the welded joint will prove all the more effective in the event an internal pressure of the sealed housing is exerted because the deformation of the end plate section is large.

Also, this invention is more effective when a high-pressure refrigerant HFC32 or a mixed refrigerant containing HFC32 is used as the refrigerant.

DESCRIPTION OF THE PREFERRED EMBODIMENTS

Exemplary embodiments of the present invention are described with respect to the figures.

Figure 1:
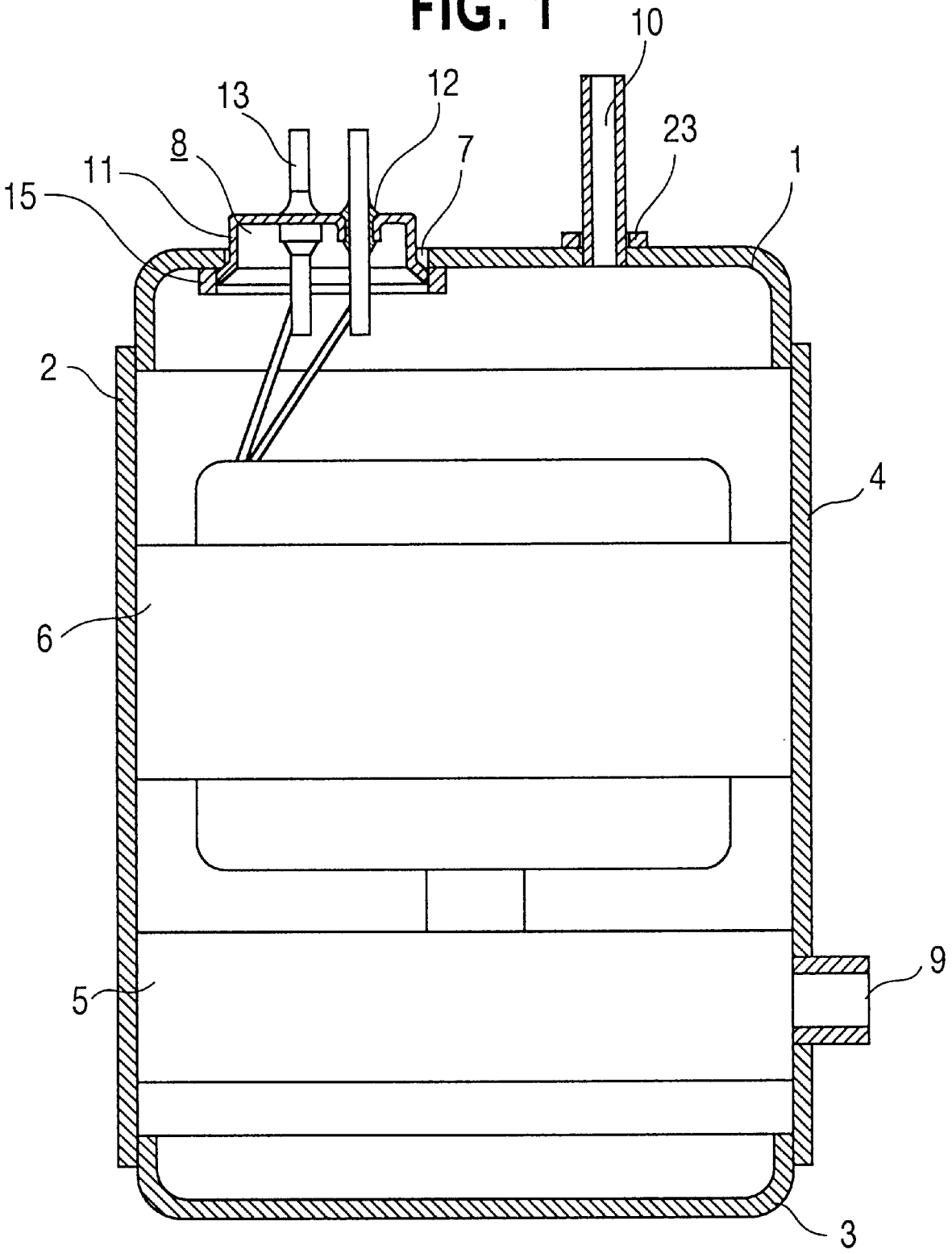
FIG. 1 is a vertical cross sectional view of a sealed type compressor in a first exemplary embodiment of the present invention.

First Exemplary Embodiment:

FIG. 1 is a vertical cross sectional view of a sealed type compressor in a first exemplary embodiment of the present invention. As shown in the figure, the sealed type compressor has a structure in which a compression mechanism 5 and a motor 6 to drive the compression mechanism 5 are disposed inside a sealed housing 4 which comprises an upper end plate 1, a cylindrical body section 2, and a lower end plate 3. Although details of the compression mechanism 5 are not shown, it can be of a rotary type or a scroll type. Electric power for the motor 6 is supplied from an external power supply (not shown) through a hermetic terminal 8 which is hermetically welded to a hole 7 provided in the upper end plate 1 of the sealed housing 4.

A refrigerant is sucked through a suction pipe 9 (connecting pipe) that leads to a refrigerating circuit (not shown), compressed by the compression mechanism 5, discharged into the sealed housing 4 with a high pressure, and returned to the refrigerating circuit (not shown) through a discharge pipe 10 (connecting pipe). Accordingly, in this exemplary embodiment, the inside of the sealed housing 4 is filled with a a high-pressure refrigerant, a structure so-called high-pressure type compressor.

Figure 2:
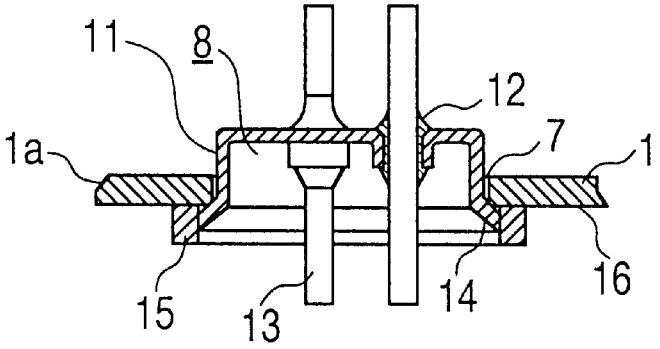
FIG. 2 is a vertical cross sectional view of a hermetic terminal section of the compressor.

FIG. 2 is an enlarged view of the hermetic terminal 8 of the sealed type compressor shown in FIG. 1. The hermetic terminal 8 has on the top surface of a cup-shaped metal member 11 an electrically conducting pin 13 insulated by a glass seal 12. The bottom part of the cup-shaped metal member 11 has a skirt section 14 expanded like a skirt, with which the cup-shaped metal member 11 is hermetically welded to the hole 7 provided on a flat section of the upper end plate 1. A ring-shaped metal member 15 constitutes a member to enhance rigidity (rigidity against deformation of the flat section) of the sealed housing and is welded to the outer periphery of the skirt section 14, which is inside the sealed housing 4, of the hermetic terminal 8 .

The material of the ring-shaped metal member 15 is generally-available steel and its thickness is set to a value greater than ⅓ of the thickness of the upper end plate 1. To be more specific, in this exemplary embodiment, the thickness of the end plate 1 of the sealed housing 4 made of steel is chosen to be between 3 mm and 4 mm while the thickness of the ring-shaped metal member 15 is chosen to be between 1.5 mm and 5 mm. The width of the ring of the ring-shaped metal member 15 is chosen to be between 2 mm and 4 mm. The inner diameter of the ring-shaped metal member 15 is set to be greater than the outer diameter of the skirt section 14 of the hermetic terminal 8.

Figure 3:
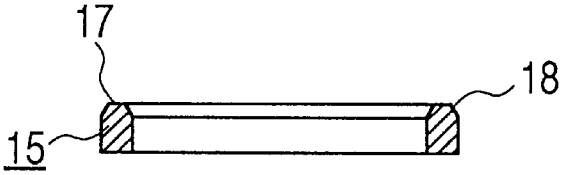
FIG. 3 is a cross sectional view of a ring-shaped metal member of the compressor.

Assembly by welding of the ring-shaped metal member 15 and the hermetic terminal 8 onto the upper end plate 1 is next described. At the location on the upper end plate 1 where the hermetic terminal 8 is to be disposed, a hole 7 slightly larger than the outer diameter of the cup-shaped metal member 11 is made in a surface (flat section) 16 with a relatively high degree of flatness. The ring-shaped metal member 15 is fixed by resistance welding to the outer periphery of the hole 7. Resistance welding is generally accomplished by concentrating an electric current by providing a protrusion on the part to be welded. However, in this exemplary embodiment, as resistance welding based on a protrusion produces dotted welds, it is not adopted because the ring-shaped metal member 15 will not suppress deformation of the upper end plate 1 of the sealed housing 4. Consequently, in this invention, a surface la of the ring-shaped metal member 15 which comes in contact with the upper end plate 1 is made flat with a relatively high degree of flatness, and is placed in close contact with the flat section 16 of the upper end plate 1, and then resistance welding is carried out by allowing an electric current to flow. In this case, though rigidity increases as the width of the ring increases, the current density is not increased and thus the entire surface is not uniformly welded. Accordingly, the above-described range of width of 2 mm to 4 mm is adequate. By welding in this way, an arc-shaped welded joint is obtained, and the ring-shaped metal member 15 acts to suppress the deformation of the upper end plate 1. In the case of a ring-shaped metal member 15 with a large width or when welding without allowing too large an electric current to flow, a linear protrusion 18 is provided on the tip 17 of the ring-shaped metal member 15 as shown in FIG. 3. Although it is general practice to provide the linear protrusion 18 over the entire circumference, it may be good to divide it into 3 or 4 arc sections.

Evaluation of pressure resistance of the sealed housing 4 of the sealed type compressor of the present exemplary embodiment is next described.

Generally, the pressure resistance requirement for a sealed housing of a refrigerant compressor is that it will not break when a static hydraulic pressure equal to 3 to 5 times the designed pressure value (maximum operating pressure) is applied, though slight differences exists depending on standards and laws of different countries. When a static hydraulic pressure equal to 3 to 5 times the designed pressure value is gradually applied inside the sealed housing 4 of this exemplary embodiment, the sealed housing 4 gradually swells. The upper end plate 1 especially tends to swell into the shape of a sphere. In the absence of the ring-shaped metal member 15, the skirt section 14 of the hermetic terminal 8 fixed by welding to the flat section 16 will become part of a spherical surface and is forced inward with a strong force. Because of this force and the internal static hydraulic pressure, the glass seal 12 also tends to expand outwardly in the shape of a sphere thus exerting a large force on the sealing glass causing cracks in the glass and leakage of water. However, in this exemplary embodiment, although the flat section 16 (upper end plate 1) where the hermetic terminal 8 of the sealed housing 4 is welded tends to deform in the shape of a sphere, the ring-shaped metal member 15 fixed by welding to the flat section 16 of the sealed housing 4 suppresses the deformation, and also suppresses the skirt section 14 of the hermetic terminal 8 from being forced inwardly with a strong force, thereby preventing breakage of the glass seal 12. Consequently, a sealed housing 4 having a pressure-resistance strength high enough for a high-pressure refrigerant such as R410A containing HFC32 can be realized.

Regarding the method of welding, although resistance welding was described in the foregoing, brazing may also be used with which the welded joint between the ring-shaped metal member 15 and the flat section 16 of the sealed housing 4 becomes an arc in shape. Also, even when the ring-shaped metal member 15 is not a perfect circular ring having some local cuts, or when a plurality of bow-shaped metal members are disposed encircling the weld of the hermetic terminal 8, they act to enhance the deformation rigidity of the sealed housing 4. Also, in preventing the deformation of the sealed housing 4 from exerting a large force to the glass seal 12 of the hermetic terminal 8, it is preferable to make the length of the weld to ¼ of the circumference or greater, and the members to enhance the rigidity should preferably cover ⅔ or more of the total circumference of the weld of the hermetic terminal 8.

Figure 4:
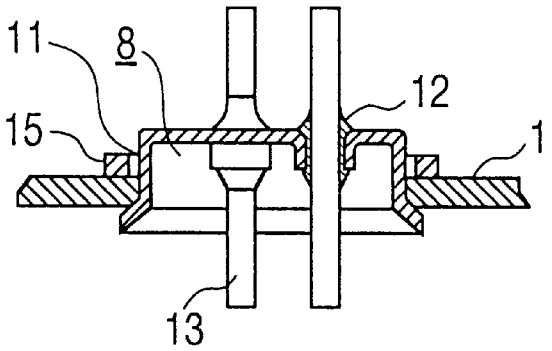
FIG. 4 is a vertical cross sectional view of a second configuration of the hermetic terminal section.
Figure 5:
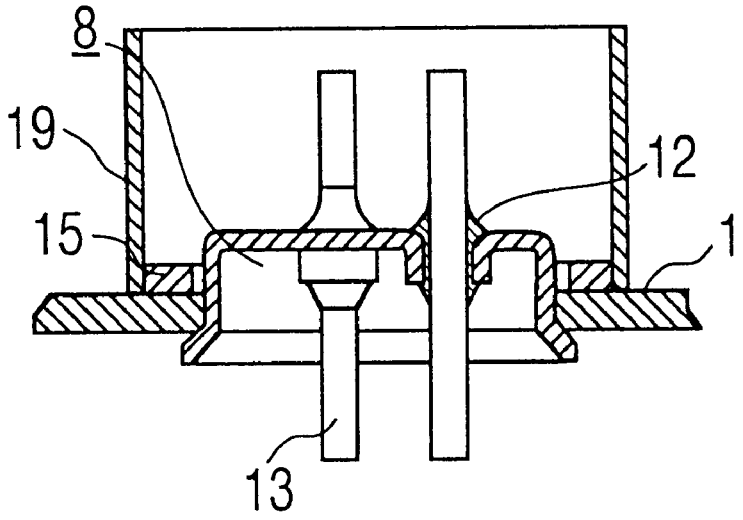
FIG. 5 is a vertical cross sectional view of a third configuration of the hermetic terminal section.
Figure 6:
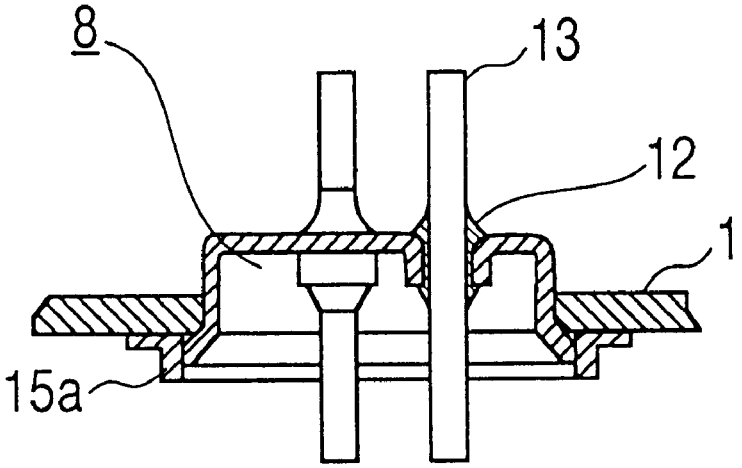
FIG. 6 is a vertical cross sectional view of a third configuration of the hermetic terminal section.
Figure 7:
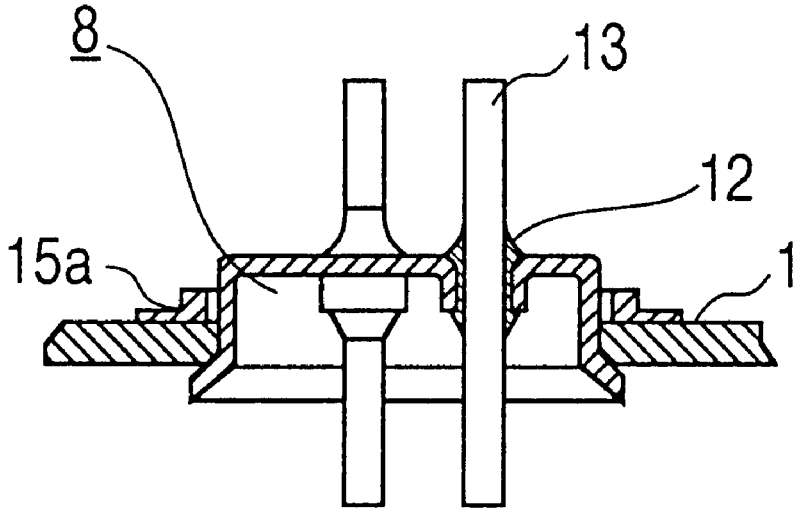
FIG. 7 is a vertical cross sectional view of a fifth configuration of the hermetic terminal section.

Although the ring-shaped metal member 15 is welded to the inside of the sealed housing 4 (upper end plate 1) in the hermetic terminal of the above-described exemplary embodiment, it may be welded to the outside of the sealed housing 4 as shown in FIG. 4. In this case, welding of the ring-shaped metal member 15 and the hermetic terminal 8 is relatively easy. Furthermore, as a protecting frame member 19 for the hermetic terminal 8 is generally disposed on the outside of the sealed housing 4, assembly work becomes easy by welding it integrally with the hermetic terminal 8 as shown in FIG. 5. Also, the shape of the ring-shaped metal member 15 may be that of a burring-processed (i.e. processed to create a burr-like projection extending circumferentially and in the axial direction, as illustrated) ring-shaped metal member 15*a* such as shown in FIG. 6 and FIG. 7.

Also, though description of the material of the ring-shaped metal members 15, 15*a* was made with reference to steel, more pronounced rigidity effect may be obtained by the use of high-tension steel.

Figure 8:
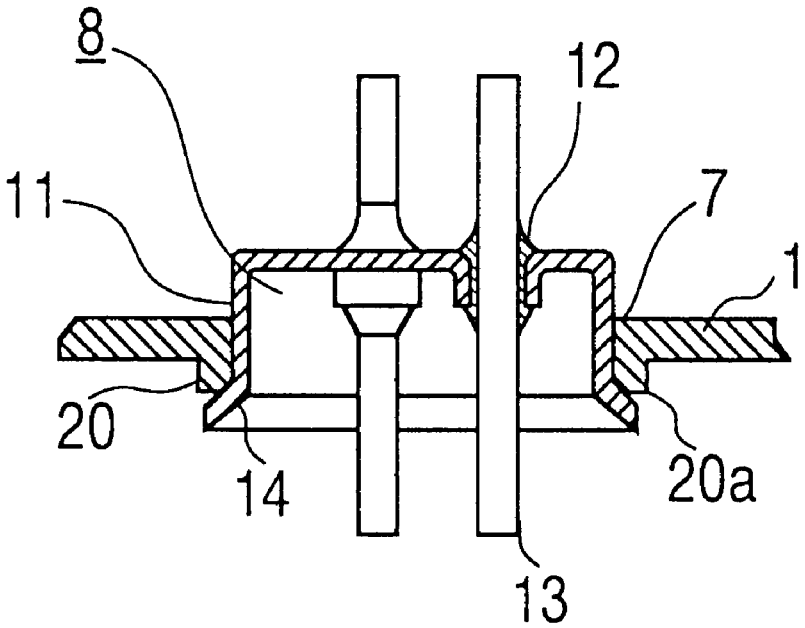
FIG. 8 is a vertical cross sectional view of a hermetic terminal section in a second exemplary embodiment of the present invention.
Figure 9:
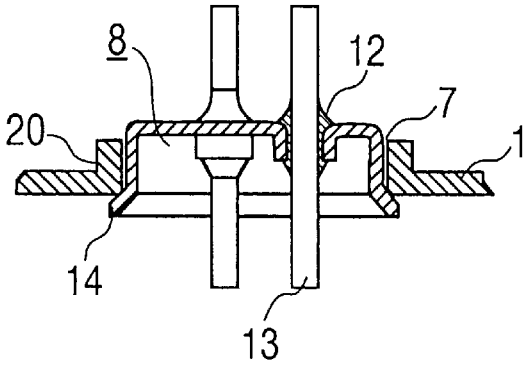
FIG. 9 is a vertical cross sectional view of a second configuration 1 of the hermetic terminal section.
Figure 10:
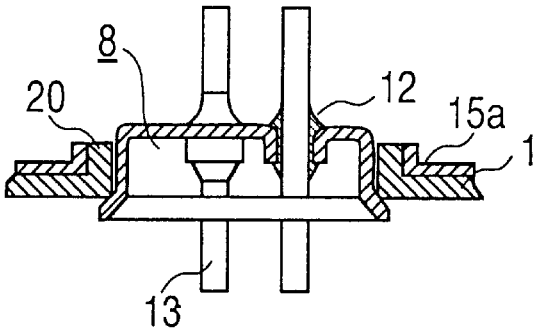
FIG. 10 is a vertical cross sectional view of a third configuration of the hermetic terminal section.

Second Exemplary Embodiment:

FIGS. 8 to 10 illustrate a hermetic terminal section in a second exemplary embodiment of the present invention.

As shown in FIG. 8, a hole 7 provided on an upper end plate 1 has a burring (i.e. burr-like projection extending circumferentially and in the axial direction) 20 formed toward the inside of a sealed housing 4. An end face 20*a* of the burring section 20 is processed into a flat surface, where a skirt section 14 of a hermetic terminal 8 is fixed by welding.

In this exemplary embodiment, as the internal pressure of the sealed housing 4 increases, the sealed housing 4 gradually swells, and the upper end plate 1 swells in the shape of a sphere. However, as the rigidity of the burring 20 is large, it acts to suppress the deformation of its inner part, and prevents breakage of a glass seal 12 of the hermetic terminal 8. Furthermore, in this exemplary embodiment, as welding of the hermetic terminal 8 is possible even when the outer periphery of the hole 7 is made in the shape of a spherical surface, the deformation of the upper end plate 1 is reduced and the pressure-resistance strength of the upper end plate 1 can be improved. Also, the cost will be less compared with the afore-mentioned welding of the ring-shaped metal members 15 and 15*a*.

Also, the hermetic terminal section shown in FIG. 9 has the above-mentioned burring 20 formed toward the outside of the sealed housing 4 (upper end plate 1). Similarly to the burring 20 formed toward the inside, rigidity of the peripheral edge of the hermetic terminal 8 is increased by the burring 20 making it difficult for deformation to take place, thus preventing breakage of the glass seal 12 and increasing the pressure-resistance strength. The deforming force exerted on the glass seal 12 is smaller when the burring 20 is formed on the outside than when it is formed on the inside. However, unless the flatness of the base part of the burring 20 is precisely obtained, welding with the hermetic terminal 8 becomes difficult.

Also, the hermetic terminal section shown in FIG. 10 is obtained by welding the ring-shaped metal member 15*a* to the outer periphery of the burring 20 shown in FIG. 9, the welding of which provides further enhancement of the rigidity.

Figure 11:
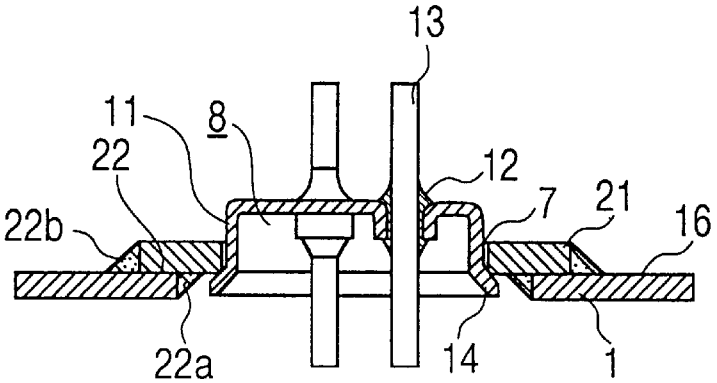
FIG. 11 is a vertical cross sectional view of a hermetic terminal section in a third exemplary embodiment of the present embodiment.

Third Exemplary Embodiment:

FIG. 11 shows a hermetic terminal section in a third exemplary embodiment of the present invention.

A hermetic terminal 8 is hermetically welded to a doughnut-shaped flat plate 21 made of steel. The thickness of the flat plate 21 is set to be greater than an upper end plate 1 of a sealed housing 4. The flat plate 21 is hermetically welded to the upper end plate 1 with an overlap 22. The length of the overlap 22 is greater than the thickness of the upper end plate 1. When the overlap 22 is large, by welding both of the inner end 22*a* and the outer end 22*b* of the overlap of the flat plate 21 with the upper end plate 1, the rigidity can be further enhanced.

In this exemplary embodiment, as the pressure inside the sealed housing 4 increases, the sealed housing 4 gradually swells, with the upper end plate 1 especially swells in the shape of a sphere. However, as the overlap 22 between the doughnut-shaped flat plate 21 made of steel and the upper end plate 1 is fixed by welding, the thickness is increased and rigidity is increased, thus suppressing the deformation of the inner part and preventing breakage of a glass seal 12 of the hermetic terminal 8. As a result, it is possible to obtain a sealed housing 4 with a pressure-resistance strength high enough for a high-pressure refrigerant containing HFC32 such as R410a.

Meanwhile, unless the thickness of the flat plate 21 is made greater than that of the upper end plate 1, the effect of preventing breakage of the glass seal 12 of the hermetic terminal 8 cannot be fully exhibited because the flat plate 21 itself deforms. Also, when the overlap 22 is small, the effect of preventing breakage of the glass seal 12 of the hermetic terminal 8 cannot be fully exhibited as bending takes place there. The length of the overlap 22 is required to be greater than the thickness of the upper end plate 1. It produces the same effect for whichever of the upper end plate 1 and the flat plate 21 is welded inside.

Figure 12:
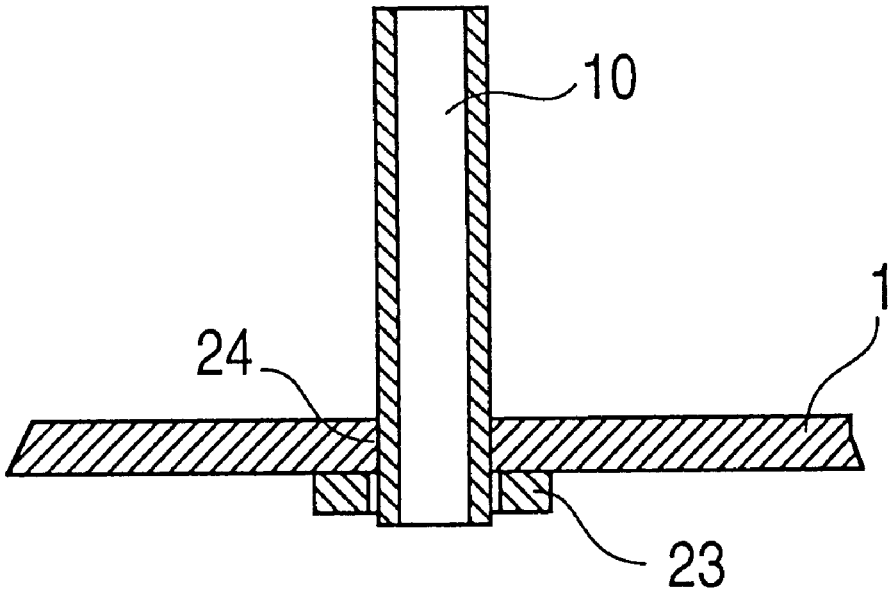
FIG. 12 is a vertical cross sectional view of a connecting pipe section in a fourth exemplary embodiment of the present invention.

Fourth Exemplary Embodiment:

FIGS. 12 through 17 illustrate a connecting pipe section through which a refrigerant goes in and out in a fourth exemplary embodiment of the present invention. As shown in FIG. 12, a discharge pipe 10, being one of the connecting pipes through which the refrigerant goes in and out from a sealed housing 4, is fixed by welding to an upper end plate 1, followed by welding a ring-shaped metal member 23 on the outer periphery of the weld. When a pressure is applied to the inside of the sealed housing 4, the upper end plate 1 deforms in the shape of a sphere. In the absence of the ring-shaped metal member 23, a tensile stress concentrates at a brazed section 24 joining the discharge pipe 10 and the upper end plate 1, and fracture is caused. However, in this structure, even when the upper end plate 1 deforms in the shape of a sphere, the deformation in the vicinity of the weld of the discharge pipe 10 is suppressed and the tensile stress is eased, thus preventing leakage of the high-pressure refrigerant to the outside due to fracture of the brazed section 24, and improving the pressure-resistance strength.

Figure 13:
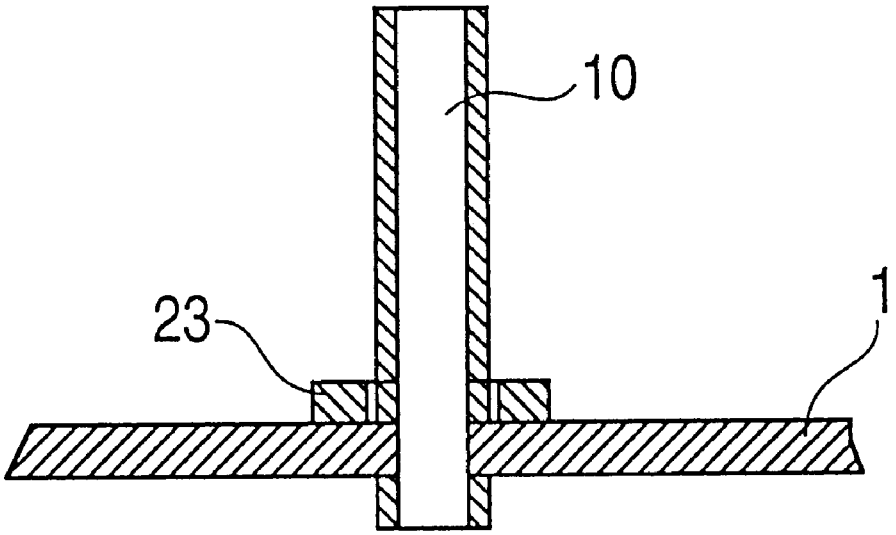
FIG. 13 is a vertical cross sectional view of a second configuration of the connecting pipe section.
Figure 14:
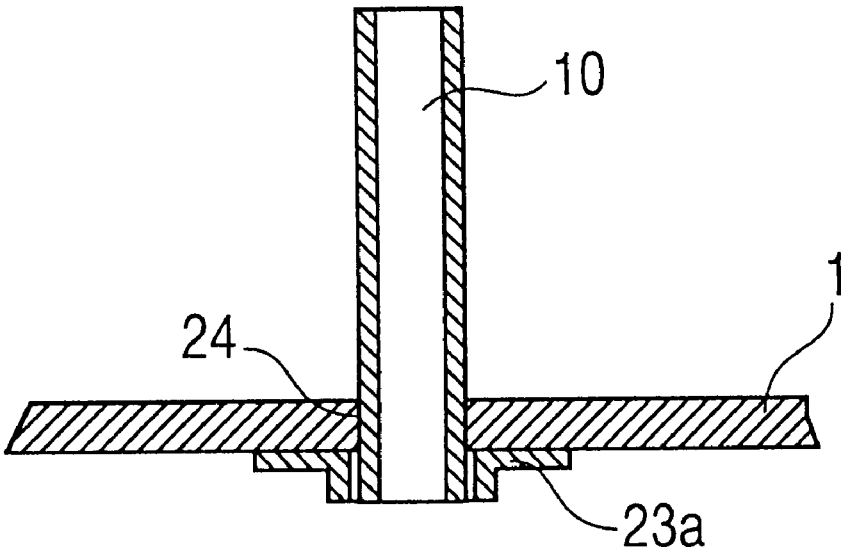
FIG. 14 is a vertical cross sectional view of a third configuration of the connecting pipe section.
Figure 15:
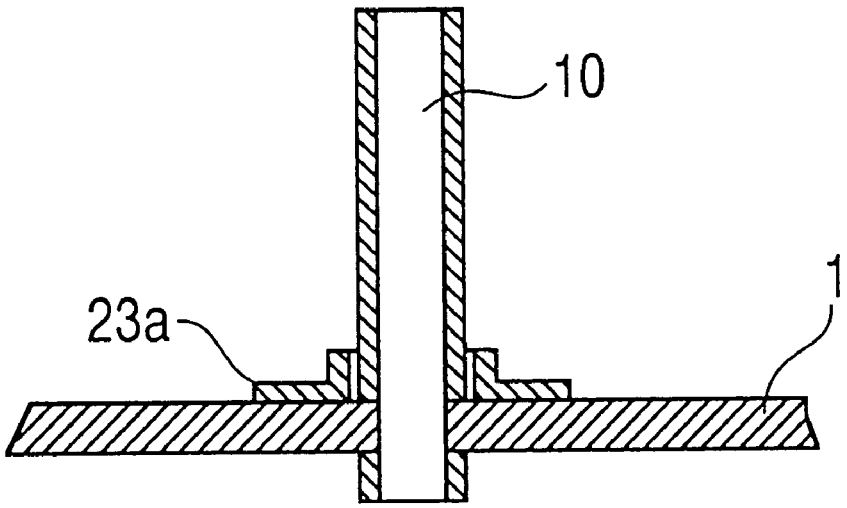
FIG. 15 is a vertical cross sectional view of a fourth configuration of the connecting pipe section.
Figure 16:
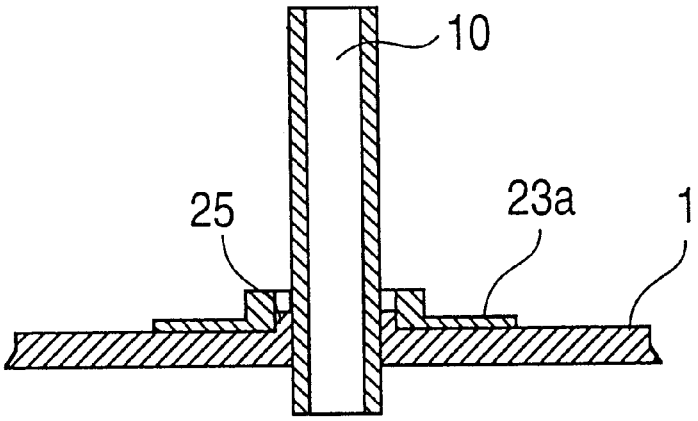
FIG. 16 is a vertical cross sectional view of a fifth configuration 4 of the connecting pipe section.
Figure 17:
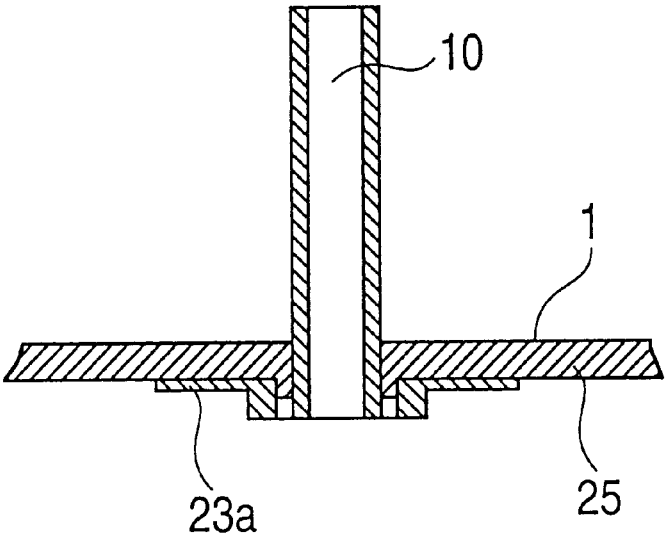
FIG. 17 is a vertical cross sectional view of a sixth configuration 5 of the connecting pipe section.

Although the ring-shaped metal member 23 is welded to the inside of the sealed housing 4 in the above-described exemplary embodiment, it may be welded to the outside of the sealed housing 4 as shown in FIG. 13. Also, the shape of the ring-shaped metal member 23 may be that of the ring-shaped metal member 23*a* having a burring as shown in FIGS. 14 and 15. Furthermore, by forming a burring (burr-like projection) 25 on the outer periphery of the weld of the upper end plate 1 and the discharge pipe 10, and welding the ring-shaped metal member 23*a* on the outer periphery of the burring 25, the rigidity may be further enhanced. Also, as connecting pipes are generally welded by copper brazing, assembling becomes easier by brazing the nearby ring-shaped metal members 23 and 23*a* at the same time.

As set forth above, in the present invention, when the sealed housing 4 comprises the body section 2, the upper end plate 1 and the lower end plate 3, and the hermetic terminal 8 and the discharge pipe 10 are welded to the upper end plate 1, the invention is still more effective as the deformation of the upper end plate 1 is large. Also, the effect is more pronounced when used for a high-pressure refrigerant HFC32 or a high-pressure mixed refrigerant such as R410A containing HFC32.

Figure 18:
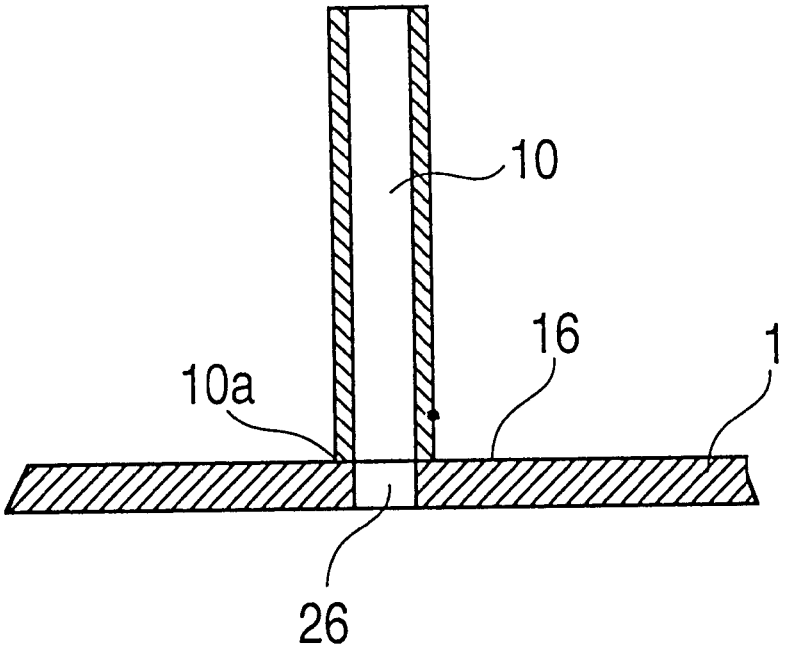
FIG. 18 is a vertical cross sectional view of a connecting pipe section in a fifth exemplary embodiment of the present invention.

Fifth Exemplary Embodiment:

FIG. 18 shows a connecting pipe section through which a refrigerant goes in and out in a fifth exemplary embodiment of the present invention. A small hole 26 having a diameter equal to or smaller than the inner diameter of a discharge pipe 10 constituting a connecting pipe is made in a flat section 16 of a sealed housing 4 (upper end plate 1), and the end face 10*a* of the discharge pipe is fixed by welding to the flat section 16 corresponding to the hole 26. As a method of welding, silver brazing may be adopted. However, a greater pipe strength may be obtained by employing diffusion welding in which an electric current is allowed to flow while a discharge pipe 10 made of copper, for instance, is being pressed to the flat section 16 thus making copper of the discharge pipe 10 diffuse into the sealed housing 4 because the temperature rise is smaller when compared with welding by brazing and the like.

When a large pressure is applied to the inside of the sealed housing 4, the upper end plate 1 deforms in the shape of a sphere. If the position of the welded joint of the discharge pipe 10 is inside of the hole as in the prior art, a tensile stress in the direction of opening the welded joint is exerted by the spherical deformation of the upper end plate 1. However, since the position of the welded joint of the end face 10*a* of the discharge pipe is on the surface of the upper end plate 1 differently from the prior art, no crack or the like will be caused on the welded joint as no tensile stress is exerted, thus improving the pressure-resistance strength of the sealed housing 4. Also, the resistance to refrigerant flow may be reduced by expanding that end face 10*a* of the discharge pipe 10 which is on the side to be fixed by welding to the upper end plate 1 and by expanding the diameter of the hole 26 on the upper end plate 1.

Figure 19:
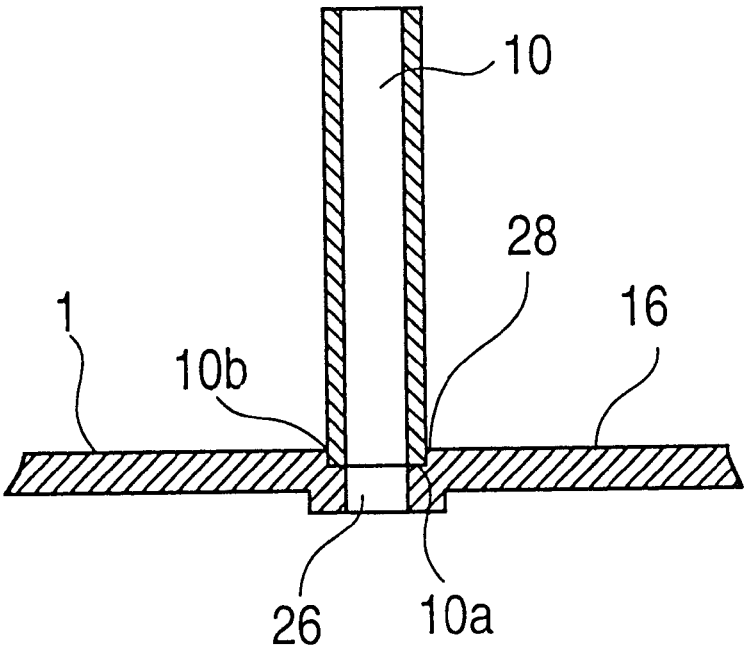
FIG. 19 is a vertical cross sectional view of a connecting pipe section in a sixth exemplary embodiment of the present invention.
Figure 20:
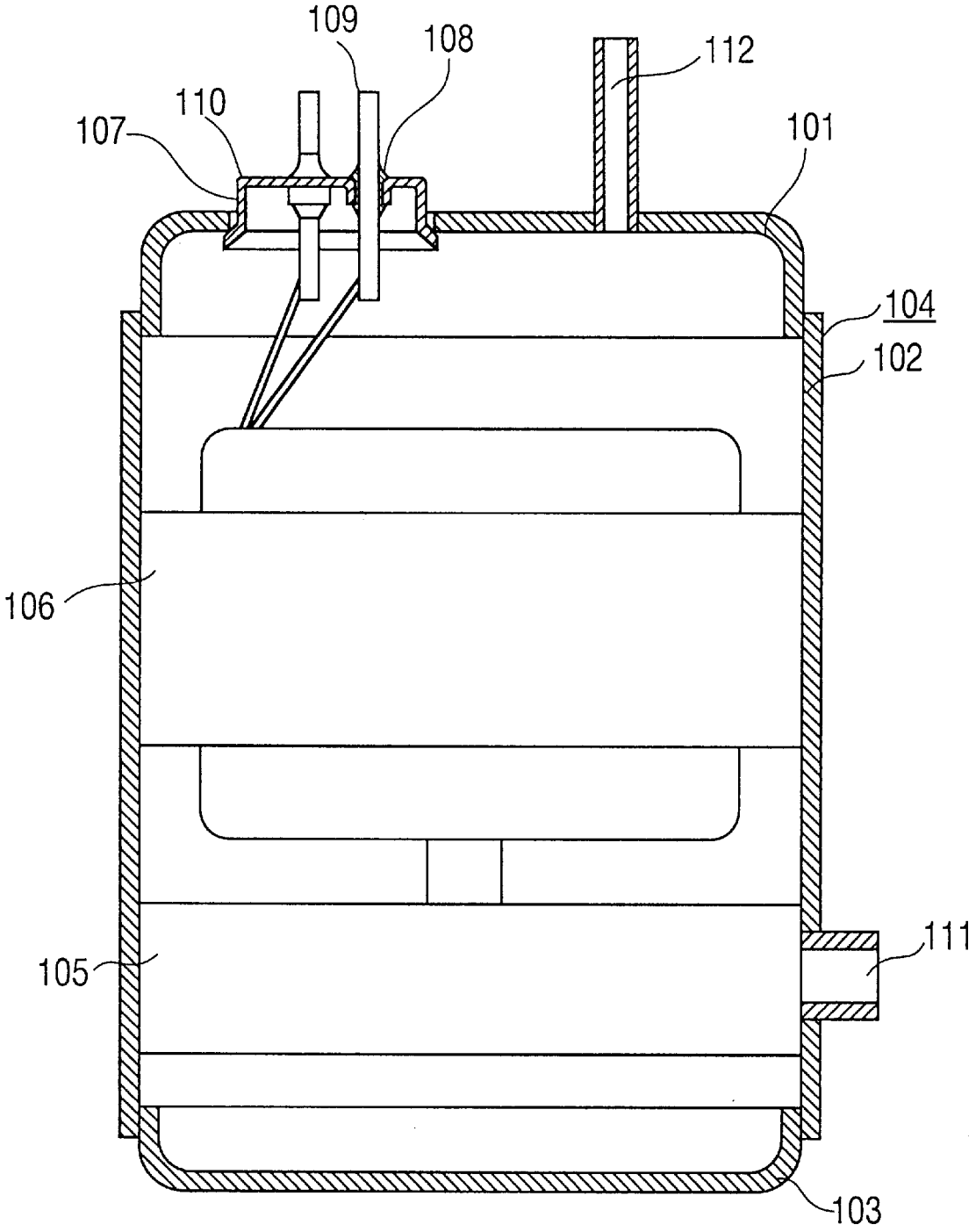
FIG. 20 is a cross sectional view of a prior art sealed type compressor.

Sixth Exemplary Embodiment:

FIG. 19 shows a connecting pipe section through which a refrigerant goes in and out in a sixth exemplary embodiment of the present invention. A small hole 26 having a diameter equal to or smaller than the inner diameter of a discharge pipe 10 is made in on a flat section 16 of a sealed housing 4 (upper end plate 1). A recessed section 28 having a diameter equal to or slightly larger than the outer diameter of the discharge pipe 10 is made at the periphery of the hole 26, into which the discharge pipe end section 10*b* is inserted, and both the outer periphery of the discharge pipe end section 10*b* and the discharge pipe end face 10*a* are fixed by brazing and the like.

In the above structure, when a large pressure is applied to the inside of the sealed housing 4, the upper end plate 1 is deformed in the shape of a sphere. If the position of the welded joint of the discharge pipe 10 is inside the hole as in the prior art, a tensile stress in the direction of opening the welded joint is exerted by the spherical deformation of the upper end plate 1. In the above structure, however, as the position of the welded joint is at both the outer periphery of the discharge pipe end section 10*b* and the discharge pipe end face 10*a*, even though a tensile stress is exerted to the outer periphery of the discharge pipe end section 10*b*, a crack will not extend to the weld of the discharge pipe end face 10*a* thus maintaining hermeticity. Also, when a force is exerted to the discharge pipe 10, though a bending stress is exerted to the weld, the outer periphery of the discharge pipe end section 10*b* inserted in the recessed section 28 supports it, thus relieving the discharge pipe end face 10*a* from the tensile stress and providing enough strength to the welded joint.

In the fifth and sixth exemplary embodiments, when the sealed housing comprises a body section and upper and lower end plates, and a hermetic terminal and one of the connecting pipes is welded to one of the end plates, that one of the end plates will have two or more holes, thereby causing larger deformation. Therefore, employment of the above-described method of welding will be further effective. Also, when applied to refrigerants in general such as R22 and the like, cost reduction may be possible by reducing the thickness of the sealed housing or the grade of its material. When applied to high-pressure refrigerants such as HFC32 or R410A containing HFC32, the pressure resistance of the sealed housing may be more effectively improved.

As has been described in the foregoing exemplary embodiments, in the present invention, a member to enhance rigidity of the sealed housing is welded to the sealed housing encircling the weld of the hermetic terminal. Consequently, even when the inside of the sealed housing becomes high in pressure and the sealed housing to which the hermetic terminal is welded is deformed, the member to enhance the rigidity of the outer periphery of the weld of the hermetic terminal suppresses the deformation of the hermetic terminal and prevents breakage of the glass seal of the hermetic terminal, thus realizing a sealed type compressor having a high pressure resistance.

Also, by resistance welding the ring-shaped metal member to the sealed housing, the entire area of the ring-shaped metal member can be fixed by welding to the sealed housing deformation of the end plates which can effectively suppress deformation of the hermetic terminal and a sealed type compressor with a high pressure-resistance strength can be realized.

Also, in this invention, by providing a burring-processed hole on the sealed housing and hermetically welding the hermetic terminal to the hole, it is difficult for deformation of the periphery of the hermetic terminal to take place because of the burring, thus preventing breakage of the glass seal and improving the pressure-resistance strength.

Also, in this invention, the hermetic terminal is hermetically welded to a plate material followed by hermetically welding the plate material to the sealed housing with an overlap. As a result, in the event the inside of the sealed housing becomes high in pressure and the end plate to which the hermetic terminal is welded deforms, it is possible to suppress the deformation of the hermetic terminal as the rigidity of the overlap is large and to prevent breakage of the glass seal of the hermetic terminal thus realizing a sealed type compressor having a large pressure-resistance strength.

The invention is especially effective in a structure in which a sealed housing comprises a body section and end plates closing openings of the body section, and a hermetic terminal is hermetically welded to one of the end plates.

Also, in this invention, by welding a ring-shaped metal member on the outer periphery of the weld of the connecting pipes (discharge pipe and suction pipe), the tensile stress produced in the weld by the deformation of the sealed housing due to internal pressure of the connecting pipes is reduced, and the pressure-resistance strength of the joints of the connecting pipes is improved. Furthermore, by brazing both the connecting pipes and the ring-shaped metal member, assembly becomes easy.

Also, in this invention, a hole having a diameter equal to or smaller than the inner diameter of a connecting pipe is made in a flat section of the sealed housing and an end face of the connecting pipe is fixed by welding to the outside surface of the sealed housing. As a result, in the event a high pressure is exerted to the inside of the sealed housing, no large tensile stress is exerted to the weld and thus the pressure-resistance strength of the sealed housing is improved.

The invention also provides a recessed section at the periphery of a hole in the sealed housing into which an end portion of a connecting pipe is inserted and fixed by welding. By fixing by welding both the end face of the connecting pipe and the outer periphery of the end portion, in the event a large force is exerted to the pipe, breakage it is difficult to take place as welded joints exist at two locations facing different directions, thus improving pressure-resistance strength of the sealed housing and providing a sealed type compressor with a strength high enough to withstand a large force that may be exerted to the pipes.

Also, when the sealed housing comprises a body section and end plates, and a hermetic terminal and connecting pipes are welded to the end plates, the invention is further effective as the deformation of the end plates is large.

When practiced with a high-pressure refrigerant HFC32 or a refrigerant containing HFC32, the effect of the invention is more pronounced.

What is claimed is:

1. A sealed type compressor comprising:

a sealed housing wherein a motor and a compression mechanism to be driven by said motor are disposed; and a hermetic terminal hermetically welded to said sealed housing at a welded joint for supplying power to said motor from outside said sealed housing; said hermetic terminal comprising:

a cup-shaped metal member;

an electrically conducting pin; and a glass seal to insulate between said cup-shaped metal member and said electrically conducting pin;

wherein a ring-shaped metal member to enhance rigidity against deformation of said sealed housing is welded encircling the welded joint between said sealed housing and said hermetic terminal.

2. A sealed type compressor comprising:

a sealed housing;

a motor and a compression mechanism driven by said motor disposed inside said sealed housing;

wherein a hole is formed in said sealed housing;

wherein a discharge pipe is aligned with said hole, connects an inside and an outside of said sealed housing and allows a refrigerant to flow out of said sealed housing;

wherein said hole has a diameter equal to or smaller than an inside diameter of said discharge pipe;

wherein a recessed section is formed in said sealed housing about a periphery of said hole; and wherein an end section of said discharge pipe is inserted into said recessed section and fixed thereto by welding.

3. The sealed type compressor according to claim 1, wherein a weld at which said ring-shaped metal member is welded to said sealed housing is an arc in shape.

4. The sealed type compressor according to claim 1, wherein said ring-shaped metal member is welded to the inside of said sealed housing.

5. The sealed type compressor according to claim 1, wherein said ring-shaped metal member is welded to the outside of said sealed housing.

6. The sealed type compressor according to claim 5, wherein said ring-shaped metal member is welded into one piece with the protecting frame member of said hermetic terminal.

7. The sealed type compressor according to claim 1, wherein said ring-shaped metal member is resistance welded to said sealed housing.

8. The sealed type compressor according to claim 7, wherein a width of said ring-shaped metal member is not greater than 4 mm and said ring-shaped metal member is resistance welded to said sealed housing without providing a protrusion in the welded joint.

9. The sealed type compressor according to claim 7, wherein said ring-shaped metal member is welded to said sealed housing with a linear protrusion provided in the welded joint.

10. A sealed type compressor comprising:

a sealed housing wherein a motor and a compression mechanism to be driven by said motor are disposed; and a hermetic terminal hermetically welded to said sealed housing for supplying power to said motor from outside said sealed housing; said hermetic terminal comprising:

a cup-shaped metal member;

an electrically conducting pin; and a glass seal to insulate between said cup-shaped metal member and said electrically conducting pin;

wherein a hole is provided in said sealed housing said sealed housing includes a generally axial burr-like projection provided at a periphery of said hole, and said hermetic terminal is hermetically welded to said burr-like projection.

11. The sealed type compressor according to claim 10, wherein said burr-like projection projects toward the inside of said sealed housing.

12. The sealed type compressor according to claim 10, wherein said burr-like projection projects toward the outside of said sealed housing.

13. A sealed type compressor comprising:

a sealed housing wherein a motor and a compression mechanism to be driven by said motor are disposed; and a hermetic terminal hermetically welded to said sealed housing for supplying power to said motor from outside said sealed housing; said hermetic terminal comprising:

a cup-shaped metal member;

an electrically conducting pin; and a glass seal to insulate between said cup-shaped metal member and said electrically conducting pin;

wherein said hermetic terminal is hermetically welded to a plate member, and said plate member is hermetically welded to said sealed housing with an overlap therebetween.

14. The sealed type compressor according to claim 13, wherein a thickness of said plate member is greater than and a thickness of said sealed housing.

15. The sealed type compressor according to claim 13, wherein a length of the overlap between said plate member and said sealed housing is greater than a thickness of said sealed housing.

16. The sealed type compressor according to any one of claim 1, wherein said sealed housing comprises a body section and an end plate section to close an opening of said body section, and said hermetic terminal is hermetically welded to said end plate section.

17. A sealed type compressor comprising a sealed housing; a motor and a compression mechanism driven by said motor disposed in said sealed housing; a connecting pipe, connecting the inside and the outside of said sealed housing and through which a refrigerant flows, fixed by a weld to said sealed housing; and a ring-shaped metal member welded around the outer periphery of the weld.

18. The sealed type compressor according to claim 17, wherein said sealed housing has a hole therein, said hole has a burr-like projection formed at its periphery, and said connecting pipe is welded to said burr-like projection in alignment with said hole.

19. The sealed type compressor according to claim 17, wherein said connecting pipe and said ring-shaped metal member are fixed to said sealed housing by brazing.

20. A sealed type compressor comprising:

a sealed housing;

a motor and a compression mechanism driven by said motor disposed inside said sealed housing;

wherein a hole is formed in a flat section of said sealed housing;

wherein a discharge pipe is aligned with said hole, connects an inside and an outside of said sealed housing and allows a refrigerant to flow out of said sealed housing;

wherein said hole has a diameter equal to or smaller than an inside diameter of said discharge pipe; and wherein an end face of said discharge pipe is fixed by welding to an outside surface of said sealed housing.

21. The sealed type compressor according to claim 20, wherein said end face of said discharge pipe is expanded, and the diameter of said hole is equal to or smaller than the inner diameter of the expanded part of said discharge pipe.

22. The sealed type compressor according to claim 20, wherein said discharge pipe is fixed to said sealed housing by diffusion welding.

23. The sealed type compressor according to claim 17, wherein said sealed housing comprises a body section and an end plate section.

24. The sealed type compressor according to claim 1, wherein HFC32 or a mixed refrigerant containing HFC32 is used as a refrigerant in said sealed housing.

25. The sealed type compressor according to claim 2, wherein said ring-shaped metal member is welded to the inside of said sealed housing.

26. The sealed type compressor according to claim 3, wherein said ring-shaped metal member is welded to the inside of said sealed housing.

27. The sealed type compressor according to claim 25, wherein said ring-shaped metal member is welded to the outside of said sealed housing.

28. The sealed type compressor according to claim 3, wherein said ring-shaped metal member is welded to the outside of said sealed housing.

29. The sealed type compressor according to claim 2, wherein said ring-shaped metal member is resistance welded to said sealed housing.

30. The sealed type compressor according to claim 3, wherein said ring-shaped metal member is resistance welded to said sealed housing.

31. The sealed type compressor according to claim 2, wherein said sealed housing comprises a body section and plate section to close an opening of said body section, and said hermetic terminal is hermetically welded to said end plate section.

32. The sealed type compressor according to claim 3, wherein said sealed housing comprises a body section and plate section to close an opening of said body section, and said hermetic terminal is hermetically welded to said end plate section.

33. The sealed type compressor according to claim 6, wherein said sealed housing comprises a body section and plate section to close an opening of said body section, and said hermetic terminal is hermetically welded to said end plate section.

34. The sealed type compressor according to claim 8, wherein said sealed housing comprises a body section and plate section to close an opening of said body section, and said hermetic terminal is hermetically welded to said end plate section.

35. The sealed type compressor according to claim 9, wherein said sealed housing comprises a body section and plate section to close an opening of said body section, and said hermetic terminal is hermetically welded to said end plate section.

36. The sealed type compressor according to claim 10, wherein said sealed housing comprises a body section and plate section to close an opening of said body section, and said hermetic terminal is hermetically welded to said end plate section.

37. The sealed type compressor according to claim 11, wherein said sealed housing comprises a body section and plate section to close an opening of said body section, and said hermetic terminal is hermetically welded to said end plate section.

38. The sealed type compressor according to claim 12, wherein said sealed housing comprises a body section and plate section to close an opening of said body section, and said hermetic terminal is hermetically welded to said end plate section.

39. The sealed type compressor according to claim 13, wherein said sealed housing comprises a body section and plate section to close an opening of said body section, and said hermetic terminal is hermetically welded to said end plate section.

40. The sealed type compressor according to claim 14, wherein said sealed housing comprises a body section and plate section to close an opening of said body section, and said hermetic terminal is hermetically welded to said end plate section.

41. The sealed type compressor according to claim 15, wherein said sealed housing comprises a body section and plate section to close-an opening of said body section, and said hermetic terminal is hermetically welded to said end plate section.

42. The sealed type compressor according to claim 18, wherein said connecting pipe and said ring-shaped metal member are fixed to said sealed housing by brazing.

43. The sealed type compressor according to claim 20, wherein said connecting pipe is fixed by welding to said sealed housing by diffusion welding.

44. The sealed type compressor according to claim 18, wherein said sealed housing comprises a body section and an end plate section to close an opening of said body section, and said discharge pipe is welded to said end plate section.

45. The sealed type compressor according to claim 20, wherein said sealed housing comprises a body section and an end plate section to close an opening of said body section, and said discharge pipe is welded to said end plate section.

46. The sealed type compressor according to claim 21, wherein said sealed housing comprises a body section and an end plate section to close an opening of said body section, and said discharge pipe is welded to said end plate section.

47. The sealed type compressor according to claim 2, wherein said sealed housing comprises a body section and an end plate section to close an opening of said body section, and said discharge pipe is welded to said end plate section.

48. The sealed type compressor according to claim 1, wherein said sealed housing comprises a body section and an end plate section to close an opening of said body section, and said discharge pipe is welded to said end plate section.

49. The sealed type compressor according to claim 2, wherein HFC32 or a mixed refrigerant containing HFC32 is used as a refrigerant in said sealed housing.

50. The sealed type compressor according to claim 3, wherein HFC32 or a mixed refrigerant containing HFC32 is used as a refrigerant in said sealed housing.

51. The sealed type compressor according to claim 6, wherein HFC32 or a mixed refrigerant containing HFC32 is used as a refrigerant in said sealed housing.

52. The sealed type compressor according to claim 8, wherein HFC32 or a mixed refrigerant containing HFC32 is used as a refrigerant in said sealed housing.

53. The sealed type compressor according to claim 9, wherein HFC32 or a mixed refrigerant containing HFC32 is used as a refrigerant in said sealed housing.

54. The sealed type compressor according to claim 10, wherein HFC32 or a mixed refrigerant containing HFC32 is used as a refrigerant in said sealed housing.

55. The sealed type compressor according to claim 11, wherein HFC32 or a mixed refrigerant containing HFC32 is used as a refrigerant in said sealed housing.

56. The sealed type compressor according to claim 12, wherein HFC32 or a mixed refrigerant containing HFC32 is used as a refrigerant in said sealed housing.

57. The sealed type compressor according to claim 13, wherein HFC32 or a mixed refrigerant containing HFC32 is used as a refrigerant in said sealed housing.

58. The sealed type compressor according to claim 14, wherein HFC32 or a mixed refrigerant containing HFC32 is used as a refrigerant in said sealed housing.

59. The sealed type compressor according to claim 15, wherein HFC32 or a mixed refrigerant containing HFC32 is used as a refrigerant in said sealed housing.

60. The sealed type compressor according to claim 17, wherein HFC32 or a mixed refrigerant containing HFC32 is used as said refrigerant.

61. The sealed type compressor according to claim 18, wherein HFC32 or a mixed refrigerant containing HFC32 is used as said refrigerant.

62. The sealed type compressor according to claim 20, wherein HFC32 or a mixed refrigerant containing HFC32 is used as said refrigerant.

63. The sealed type compressor according to claim 21, wherein HFC32 or a mixed refrigerant containing HFC32 is used as said refrigerant.

64. The sealed type compressor according to claim 2, wherein HFC32 or a mixed refrigerant containing HFC32 is used as said refrigerant.

65. The sealed type compressor according to claim 2, wherein both an end face and an outer periphery of said section of said discharge pipe are welded by brazing to said sealed housing.

66. The sealed type compressor according to claim 65, wherein HFC32 or a mixed refrigerant containing HFC32 is used as said refrigerant.

67. The sealed type compressor according to claim 20, wherein said discharge pipe is operably coupled to a discharge side of said compression mechanism.

68. The sealed type compressor according to claim 1, wherein a thickness of said ring-shaped metal member is greater than ⅓ of a thickness of said sealed housing.

69. The sealed type compressor according to claim 2, wherein said discharge pipe is operably coupled to a discharge side of said compression mechanism.

* * * * *